US007699682B1

(12) United States Patent
Scott, Sr.

(10) Patent No.: US 7,699,682 B1
(45) Date of Patent: Apr. 20, 2010

(54) EXERCISE AND PLAY ADVOCATE DEVICE

(76) Inventor: Marvin B. Scott, Sr., 4246 W. Washington Blvd., Chicago, IN (US) 60624

( * ) Notice: Subject to any disclaimer, the term of this patent is extended or adjusted under 35 U.S.C. 154(b) by 376 days.

(21) Appl. No.: 11/524,646

(22) Filed: Dec. 14, 2006

(51) Int. Cl.
*A63H 33/02* (2006.01)

(52) U.S. Cl. ..... 446/453; D21/457; 446/450; 482/148

(58) Field of Classification Search ..... 446/450–453, 446/431; 273/126 R, 425; 280/205, 182; D21/457
See application file for complete search history.

(56) References Cited

U.S. PATENT DOCUMENTS 1,370,822 A * 3/1921 Koch ..... 99/350
1,906,480 A * 5/1933 Metz ..... 446/450
2,149,960 A * 3/1939 Heath ..... 446/450
3,001,324 A * 9/1961 Walker ..... 446/450
3,531,889 A * 10/1970 Foole ..... 446/450
3,696,556 A * 10/1972 Plasket ..... 446/450
3,881,277 A * 5/1975 Delph et al. ..... 446/450
4,148,153 A * 4/1979 Phillips, Jr. ..... 446/450
D322,107 S * 12/1991 Zoghopoulos ..... D21/457
D325,756 S * 4/1992 Grey ..... D21/457
5,299,970 A * 4/1994 Fontaine ..... 446/453
D411,589 S * 6/1999 Latham ..... D21/457
5,989,097 A * 11/1999 Lebedz ..... 446/450
D500,532 S * 1/2005 Friedman ..... D21/457

* cited by examiner

*Primary Examiner*—Gene Kim
*Assistant Examiner*—Matthew B Stanczak
(74) *Attorney, Agent, or Firm*—Overhauser & Lindman, LLC

(57) ABSTRACT

A hoop-rolling device is used by children and adults for fitness and recreation. An illustrative embodiment includes a hoop and a shaft, with a generally square-shaped ring retaining the hoop, which is used to propel and control the hoop. The ring defines a small aperture permitting selective insertion and removal of the hoop. The shaft also includes a curved handle. The device is constructed of rigid materials to allow for extended play on a variety of solid surfaces.

1 Claim, 2 Drawing Sheets

EXERCISE AND PLAY ADVOCATE DEVICE

FIELD OF THE INVENTION

The present disclosure relates to devices for exercise and recreation, and particularly to a hoop-rolling device used to develop fitness, agility, dexterity, and concentration.

BACKGROUND

In today's era of captivating video games, cable and satellite television systems with hundreds of channels, and generally more sedentary lifestyles, the promotion of fitness and an active lifestyle is a noble pursuit. Especially when it comes to children, inadequate physical fitness is a major problem and can contribute to a lifetime of obesity, osteoporosis, arthritis, and other health concerns, including those of the mental variety. Specific fitness goals commonly encountered are improvements in endurance, balance, speed of movement, and coordination of movement.

While the cardiovascular, strength, skeletal, and stress-reducing benefits of walking and running are well-documented, various devices in the prior art seek to further motivate children and adults to exercise. Certain devices include hoop-rolling functionality for fun and fitness. However, such devices may employ hoops which have a thin, rounded cross-section, resulting in control difficulties, or a rolling-hoop retainer ineffective for extended play. Others may not accommodate users of varying heights. Still other devices, for example, may not have a hoop or propelling device which is composed of resilient material.

SUMMARY OF THE INVENTION

The present invention may comprise one or more of the following features and combinations thereof.

An illustrative hoop-rolling device to promote active recreation and fitness in children and adults which includes a durable hoop with a flat, wide outer periphery and a durable propelling shaft with a handle at one longitudinal end and a generally square-shaped retaining ring at the other longitudinal end. The ring has a narrow aperture to allow easy insertion and removal of a portion of the hoop.

Various embodiments of the hoop and the shaft may be configured for users of different heights. In one illustrative embodiment, the hoop is cross-sectionally rectilinear, but it could, in the alternative, be cross-sectionally square. Advantageously, the illustrative device is portable and can be used in a myriad of environments, indoor and outdoor.

Additional features of the disclosure will become apparent to individuals skilled in the art upon consideration of the following detailed description of the illustrative embodiment.

BRIEF DESCRIPTION OF THE DRAWINGS

The detailed description particularly refers to the accompanying figures in which.

DETAILED DESCRIPTION OF THE ILLUSTRATIVE EMBODIMENTS

Figure 1:
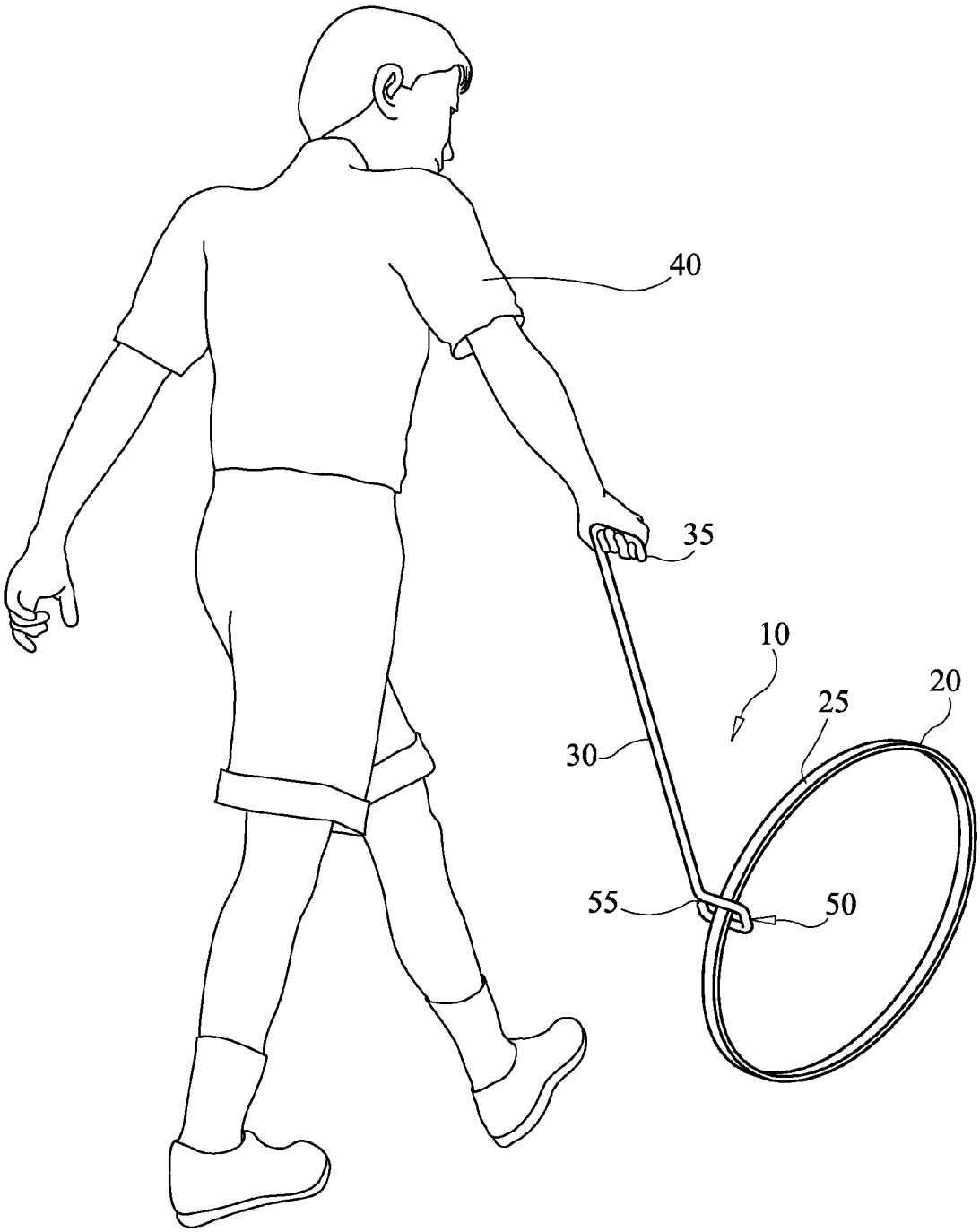
FIG. 1 is a perspective view of a first illustrative embodiment of a hoop-rolling exercise and recreation device in use.

For the purposes of promoting and understanding the principals of the invention, reference will now be made to one or more illustrative embodiments shown in the drawings and specific language will be used to describe the same.

Referring to FIG. 1, a first illustrative embodiment of a hoop-rolling device 10 is shown in use. The device 10 includes a hoop 20 which, for exercise and entertainment, is propelled and controlled through the use of a shaft 30. The goal for a user 40, who may be of virtually any age, is to guide the hoop 20 and keep it rolling continuously as he or she walks, jogs, or runs in the otherwise usual manner. Minimal force is required to operate the device 10, but development of coordination and mental focus, among others, is added to a full-body workout as the user 40 attempts to remain alert for obstacles and variances in terrain.

In the illustrative embodiment, the hoop 20 has a level and smooth outer surface 25. The hoop 20 is confined in position, yet capable of freely rotating, by a ring 50 which is located at one longitudinal end of the shaft 30 and substantially square-shaped. The ring 50 is not a closed loop, as is depicted in FIGS. 1 and 2, and includes a gap 55 to allow insertion of a portion of the hoop 20 for rolling and removal of the hoop 20 when activity with the device 10 has been completed.

Insertion of the hoop 20 into the ring 50 may be accomplished in various ways. One technique is to hold the hoop 20 upright on a level surface with one hand and passing a cross-sectional portion of the hoop 20, at a point approximately one-third of the height of the hoop 20, through with the gap 55. Uncoupling the hoop 20 from the ring 50 merely requires pulling a cross-section of the hoop 20 through the gap 55 while stabilizing the device 10.

Figure 2:
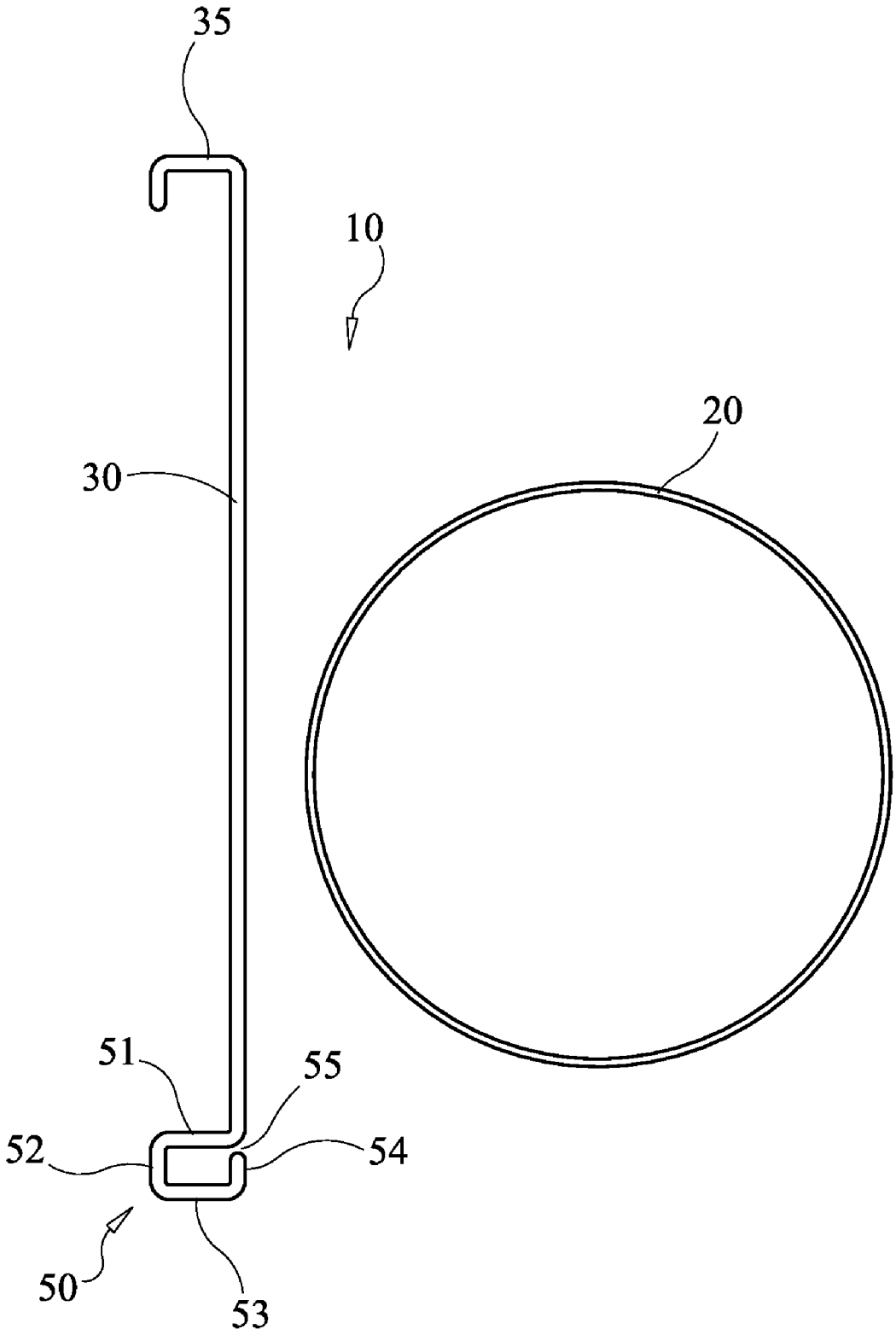
FIG. 2 is an exploded view of the hoop-rolling exercise and recreation device of FIG. 1.

As can be seen in FIG. 2, the shaft 30 also includes a handle 35 at the longitudinal end opposite from the ring 50. The handle 35, in one embodiment, is curved, large enough to allow for varying hand sizes, and may be used by left-handed and right-handed individuals alike. Optionally, the handle 35 may be ergonomic in design for comfortable grasping and possibly padded.

It is conceived that the both ring 50 and the handle 35 may either be integral with the shaft 30 or manufactured as separate pieces and later assembled.

The hoop 20, in detail, is composed of the common thermoplastic polymer polyvinyl chloride (PVC) or another rigid material which can provide similar long life and durability, but is lightweight, easily cut, non-toxic, and rust-proof. Direct cutting from a PVC pipe, including those of the standard length of twenty feet, is one manufacturing option. A saw may be used to finish edges and remove sharp corners.

Permitting variances in diameter and thickness, the hoop 20 is designed to roll on most solid surfaces. The diameter of the hoop 20 will optimally be between seven and twenty-four inches, while its thickness is at least one-quarter inch but remaining thin enough in all embodiments to selectively pass through the gap 55. The cross-sectional width of the hoop 20 may be in the range of one-half inch to two inches, with a width of one and one-half inches used in an illustrative embodiment. When cross-sectionally wider than it is thick, the hoop 20 will have a rectilinear cross-section, but a hoop 20 with a square cross-section is also operative.

In the first illustrative embodiment, the shaft 30 is made from a straight piece of galvanized metal wire or similarly robust material which is firm yet capable of being formed and resists corrosion. Lengths for the shaft 30 may fall within the range of two to five feet. A shaft 30 diameter in the range of five to six centimeters is contemplated. A wire of number 8 American gauge (AWG) is used as the shaft 30 in one embodiment. A hammer and vice may be used to shape the ring 50, as well as the handle 35.

In physical communication with the hoop 20 as the device 10 is utilized, the ring 50 releasably retains the hoop 20 for easy, safe, and efficient use, preventing wasted time and the injury which might occur if the user 40 were forced to chase a stray hoop. Substantially square-shaped, the ring 50 has three sides 51-53 measuring two inches in length in the illustrative embodiment and the remaining gap side 54 is one and one-half inches in length. The corner angles of the ring 50 need not be precise right angles.

As indicated, larger and smaller hoop 20 circumferences are certainly possible, and the device 10 could be marketed with a set of hoops. The ring 50 may need to be expanded in size to the extent a hoop 20 with a wider cross-section is used.

The illustrative device 10 is capable of indoor and outdoor use. Navigating a turn requires tilting the device 10 to a measure generally corresponding to the degree and sharpness of the turn. With a simple 180° rotation, the device 10 may be toggled between a positioning for right-handed use and one for left-handed use. For added difficulty and development of balance and control, it is encouraged that the user 40 operate the device 10 with his or her non-dominant hand.

While the invention has been illustrated and described in detail in the foregoing drawings and description, the same is to be considered as illustrative and not restrictive in character, it being understood that only illustrative embodiments thereof have been shown and described and that all changes and modifications which are within the scope of the claimed subject matter are desired to be protected.

What is claimed is:

1. A hoop-rolling device, comprising:

a hoop composed of polyvinyl chloride (PVC) and comprising a closed loop that defines an outer surface, an inner surface, and opposing edge surfaces, said outer, inner and edge surfaces defining a rectangular cross-section in which the outer and inner surfaces are wider than the opposing edge surfaces;

and a shaft, formed from a metal rod, with a left or right handed projecting handle at one longitudinal end and, at the opposite end, a generally square-shaped retaining ring coplanar with the remainder of the shaft and having first, second, third, and fourth members formed by fixed bends in the metal rod;

the first and third members of the ring are parallel and the second and fourth members are parallel, with the fourth member shorter in length than the other three members, thereby defining a narrow gap which allows selective insertion and removal of a portion of the hoop wherein the gap is equal to or less than the width of the outer and inner surfaces of the hoop but greater than the opposing edge surfaces of the hoop;

whereby the hoop is capable of rolling, but retained by the square-shaped ring, as the device is used.

* * * * *